US005669937A

United States Patent [19]

McBride et al.

[11] Patent Number: 5,669,937

[45] Date of Patent: Sep. 23, 1997

[54] METHOD TO REMOVE IODINE STAIN

[75] Inventors: Daniel T. McBride, Chesnee; John D. Bruhnke, Spartanburg, both of S.C.

[73] Assignee: Milliken Research Corporation, Spartanburg, S.C.

[21] Appl. No.: 612,161

[22] Filed: Mar. 7, 1996

[51] Int. Cl.[6] ..... D06L 1/00; D06L 1/12

[52] U.S. Cl. ..... 8/137; 8/102; 510/278; 510/280; 510/361; 510/276; 510/400; 510/405; 510/434; 510/437; 510/281; 510/282; 510/283

[58] Field of Search ..... 8/137, 102, 645; 510/278, 280, 361, 276, 400, 405, 434, 437, 281, 282, 283

[56] References Cited

U.S. PATENT DOCUMENTS

| | | | |
|---|---|---|---|
| 2,283,214 | 5/1942 | Kyrides | 510/361 |
| 3,881,047 | 4/1975 | Massey et al. | 428/378 |
| 3,911,107 | 10/1975 | Krezanoski | 424/78 |
| 3,953,352 | 4/1976 | Mitzutani et al. . | |
| 4,013,579 | 3/1977 | Nakasone et al. . | |
| 4,031,209 | 6/1977 | Krezanoski | 424/150 |
| 4,344,932 | 8/1982 | Gordon | 424/61 |
| 4,434,067 | 2/1984 | Malone et al. . | |
| 4,828,569 | 5/1989 | Heath et al. | 8/137 |
| 5,037,485 | 8/1991 | Chromecek et al. | 134/7 |

OTHER PUBLICATIONS

Gonzolez et al., "Sterocontrolled Iodolactonization", Organic Syntheses Collective Volumes, vol. Vii pp. 164–167.

WPI Acc No. 68–82884 P/00 (Date Unknown).

*Primary Examiner*—Alan Diamond

*Attorney, Agent, or Firm*—Terry T. Moyer; Timothy J. Monahan

[57] ABSTRACT

Iodine stains may be removed from a substrate, such as a textile, by applying a solution of carboxyalkene, having a site of unsaturation at the 4, 5-, 5, 6- or 6, 7- position.

14 Claims, No Drawings

METHOD TO REMOVE IODINE STAIN

BACKGROUND OF THE INVENTION

This invention relates to a method of decolorizing an iodine stain on a substrate, and in particular, to a method employing a carboxyalkene which may undergo iodolactonization.

Iodine is a safe and effective antiseptic. It is commonly available as tincture of iodine, an alcoholic 7% iodine solution in 5% potassium iodide solution, and as an iodophor, bactericidal complexes of iodine, such as povidone-iodine (Betadine®). One of the drawbacks of using iodine as an antiseptic, however, is its propensity to indelibly stain garments, linens, carpet, hard surfaces such as floors and counter tops, and virtually any other substrate which the iodine contacts.

The International Fabricare Institute, the Association of Professional Drycleaners and Launderers, advises that iodine forms a yellow or brown stain on fabrics which usually cannot be removed by washing. The recommended cleaning procedure is to apply iodine-potassium iodide solution, followed by blotting the stain with a sodium thiosulfate/ammonia solution poultice.

Cleaning compositions which are useful in removing iodine stains, as well as many other types of stains, are disclosed in the following United States patents: Mizutani et al., U.S. Pat. No. 3,953,352 (acidic cleaning composition comprising pyrrolidone-carboxylic acid); Nakasone et al., U.S. Pat. No. 4,013,579 (acidic cleaning composition comprising furan-carboxylic acid); Krezanoski U.S. Pat. No. 4,031,209 (aqueous solution containing sorbic acid and ethylenediaminetetraacetic acid); and Gordon U.S. Pat. No. 4,344,932 (solution containing ethylenediaminetetraacetic acid, urea and water).

Heath et al., U.S. Pat. No. 4,828,569 disclose a detergent composition useful for removing iodine stains especially stains resulting from povidone-iodine complex antiseptics. The detergent formulation contains a compound selected from N-alkyl-2-pyrrolidone, gammabutyrolactone, 2-ethyl-1,3-hexanediol or 4-methyl-1,3-dioxolane-2-one. Henkel FR 1472561 discloses a detergent for removing fabric stains, arising from general wear and food residues, which contains an oleyl alcohol ethoxylate.

A method of treating fibers with a polythiol resin to prevent staining from, for example, iodine is disclosed in Massy et al., U.S. Pat. No. 3,881,047.

A macroporous particulate cleaning powder, which has been imbibed with a stain dissolving solvent is disclosed in Cromecek et al. U.S. Pat. No. 5,037,485. Thiosulfate, hydrogen peroxide and acetic acid solutions are recommended for treating iodine stains in particular.

Despite the numerous treatments directed to stain protection and removal, there remains a need for a method of decolorizing iodine stains, which acts quickly and effectively.

SUMMARY OF THE INVENTION

Therefore, an object of the invention is to provide a method of treating a substrate to remove an iodine stain. Other objects of the invention include providing a treatment that can be applied topically to a substrate as an aqueous solution; a treatment which is not harmful to fabric substrates, even those that are dyed; a treatment which may be applied prior to conventional washing methods; an active treatment chemical which may be first absorbed into or adsorbed onto a particulate substrate and then applied to a stain; and a treatment which may be applied to a substrate as a protective finish to prevent staining. Accordingly, a method of treating a substrate to decolorize an iodine stain is provided incorporating the step of applying a carboxyalkene, having a site of unsaturation at the 4,5-, 5,6- or 6,7-position, to the substrate.

In addition to meeting the aforementioned objectives, the present invention has the advantages of being fast acting, water soluble at concentrations which are effective for stain removal and versatile, that is, the treatment may be applied in a variety of ways.

Preferably, the invention embodies one or more of the following features:

- the site of unsaturation is at the 4,5- or 5,6-position relative to the carboxy group;
- the carboxyalkene is applied to the substrate as an aqueous solution;
- the carboxyalkene is applied to a textile substrate;
- the carboxyalkene is applied to an existing iodine stain on a substrate;
- a solution of the carboxyalkene is applied to a textile substrate and dried, to provide a protective finish against iodine stains;
- the carboxyalkene is an alkenyl succinic acid; and/or
- a solution of the carboxyalkene is absorbed by a porous particulate cleaning powder, which is applied to an iodine stained substrate.

DETAILED DESCRIPTION OF THE INVENTION

Without limiting the scope of the invention, the preferred embodiments and features are hereinafter set forth. Unless otherwise indicated, all parts and percentages are by weight and conditions are ambient, i.e. one atmosphere of pressure and 25° C.

The term aryl is intended to be limited to single and fused double ring aromatic hydrocarbons. Unless otherwise specified, aliphatic hydrocarbons are from one to eighteen carbon atoms in length.

All of the United States patents cited in this specification are hereby incorporated by reference.

The term carboxyalkene is used herein to describe an alkene compound having at least one carboxy substituent group. The site of an unsaturation in the carboxyalkene is in a 4,5-, 5,6- or 6,7-position, preferably a 4,5- or 5,6-position, most preferably a 4,5-position, relative to the carboxy group. It is believed that the carboxyalkene may undergo iodolactonization in the presence of iodine.

The carboxyalkene may be characterized as a 4-pentenoic acid, 5-hexenoic acid or 6-heptenoic acid or derivatives thereof, in that the compound may include various other substituent groups. By way of example, the carboxyalkene may also be substituted with alkyl, aryl, sulfo or carboxy groups. Of particular interest are carboxyalkenes prepared by an "ene" reaction between maleic anhydride and a $C_8$–$C_{18}$ alpha olefin, such as octenyl succinic anhydride, decenyl succinic anhydride, dodecenyl succinic anhydride or octadecenyl succinic anhydride.

While the carboxyalkene may be applied to a stained substrate neat, it is generally more convenient to apply a solution of the carboxyalkene, and aqueous solutions are preferred. Alternatively, organic solvents may be employed as the solvent for the carboxyalkene, or if the organic solvent is water miscible, in combination with water. Other components may be present in the solution, such as surfactants, fragrances, coloring agents, buffers, humectints, builders, preservatives and chelating agents.

The solubility of the carboxyalkene may be increased by the presence of a cationic counter ion in the solution. By way of example, the counter ion may be selected from alkali metal, alkaline earth metal, ammonium, zinc, aluminum and zirconium ions.

The concentration of carboxyalkene in solution may vary from 0.1 weight percent up to 50 weight per cent or more, preferably from 1 to 35 weight percent. The concentration of the carboxyalkene in solution and the volume of solution employed can be readily varied by those skilled in the art to provide sufficient carboxyalkene to react with the iodine present on the stained substrate. Theoretically, one mole of the carboxyalkene is sufficient to decolorize one mole of $I_2$, but best results are obtained when an excess of the carboxyalkene is present.

The treatment of the present invention may be applied to any substrate, which has been stained with an iodine or an iodophor, or to provide a protective finish. By way of example, the treatment may be applied to textiles, including staple, continuous monofilament, spun yam, continuous multi-filament yam, woven, knit or non-woven fabric or carpet. Suitable fibers include, but are not limited to, polyamide fibers, including nylon, such as nylon 6 and nylon 6,6, and aramid fibers; polyester fibers, such as polyethylene terphthalate (PET), polyolefin fibers, acrylic fibers, polyurethane fibers, cellulosic fibers, such as cotton, rayon, and acetate; silk and wool fibers.

Hard surfaces represent another broad category of substrates which may be treated with the carboxyalkene of the present invention, and includes surfaces made from thermosetting and thermoplastic resins, ceramics, wood, and stone. These surfaces comprise counter tops, resilient flooring, tiles, cabinets and wood floors.

The carboxyalkene is effective at removing stains from skin, also.

Those skilled in the art will recognize that the carboxyalkene may be applied to a substrate by any number of techniques, including topical application to the substrate or by submerging the substrate in the treatment liquor, perhaps accompanied by scrubbing, wiping or agitation to penetrate and hasten the reaction. The treatment may be applied at ambient temperature, or the rate of reaction may be increased by heating, for example, by using the carboxyalkene at a temperature of from 25° to 100° C. Typically, the iodine stain is decolorized in one minute to six hours. After treatment with the carboxyalkene, the substrate may be rinsed with water or other solvent.

In another embodiment, the carboxyalkene or a solution of the carboxyalkene is applied to a powered cleaning agent, so that the carboxyalkene is absorbed into or adsorbed onto the surface of the particulate. Examples of suitable particulates are disclosed in Malone et al., U.S. Pat. No. 4,434,067, such as urea-formaldehyde polymers, and Chromecek et al., U.S. Pat. No. 4,037,485, such as copolymers of lauryl methacrylate and a polyunsaturated monomer selected from ethylene glycol dimethacrylate and tetraethylene glycol dimethacrylate. After having been treated with the carboxyalkene, the particulate may be applied to an iodine stained substrate, thereby decolorizing the stain.

And yet another embodiment of the invention, a protective finish may be applied to a substrate by treating the substrate with a carboxyalkene. The finish prevents the substrate from subsequently becoming stained with iodine. For example, a carboxyalkene is applied to a textile substrate to achieve an add-on of from 5 to 30 weight percent based on the weight of the textile. If the carboxyalkene is applied to the textile as a solution, the textile can be dried by conventional means, to provide a durable finish.

The invention may be further understood by reference to the following examples.

EXAMPLE 1

To a nylon 6,6 cut pile bonded carpet tile (28 oz/yd$^2$ face weight), face fiber stock dyed light pewter gray, full strength Betadine® solution, 10% povidone-iodine (1% active iodine), was padded at 100% wet pick up on the weight of face fiber, allowed to dry and stain the face fiber for 48 hours. The resulting light brown Betadine® stained carpet was then treated at room conditions with 10 ml of 30% active octenyl succinic acid dipotassium salt (OSA) in solution for 24 hours. All of the Betadine® stain was removed exposing the original pewter carpet color without damage.

EXAMPLE 2

The procedure of Example 1 was repeated in all respects except the stained carpet was treated with 10 ml of 1% active OSA solution for 24 hours. All of the Betadine® stain was removed exposing the original pewter carpet color.

EXAMPLE 3

The procedure of Example 1 was repeated in all respects except the stained carpet was treated with 10 ml of 0.25% active OSA solution for 24 hours. About 95% of the Betadine® stain was removed.

EXAMPLE 4

The procedure of Example 1 was repeated in all respects except the stained carpet was treated with 10 ml of 40% active dodecenyl succinic acid dipotassium salt solution (DDSA) for 24 hours. All of the Betadine® stain was removed exposing the original pewter carpet color.

EXAMPLE 5

The procedure of Example 1 was repeated in all respects except the stained carpet was treated with 10 ml of 1% active DDSA solution for 24 hours. About 90% of the Betadine® stain was removed.

EXAMPLE 6

(Comparative)

The procedure of Example 1 was repeated in all respects except the stained carpet was treated with 10 ml of water only. No removal of the stain was observed.

EXAMPLE 7

To a nylon 6,6 cut pile bonded carpet tile (28 oz/yd$^2$ face weight), face fiber a stock dyed light pewter gray, tincture of iodine (an alcoholic 7% iodine in 5% potassium iodide solution), was padded at 100% wet pick up on the weight of face fiber, allowed to dry and stain the face fiber for 48 hours. The resulting very dark reddish brown stain was then treated at room conditions with 10 ml of 30% active OSA solution for 24 hours. About 80% of the tincture of iodine was removed by visual color inspection. A second application of OSA to the same stain effectively removed the stain.

EXAMPLE 8

(Comparative)

The procedure of Example 7 was repeated in all respects except the stained carpet was treated with 10 ml of water only. No removal of the stain was observed.

EXAMPLE 9

To a nylon 6,6 cut pile bonded carpet tile (28 oz/yd$^2$ face weight), face fiber stock dyed light pewter gray, a 30% solution of OSA was sprayed at a 50% wet pick up on the weight of face fiber and conventionally dried. Although stiffer than the untreated carpet no visible change to the carpet was observed. To the carpet was added a 2 ml spot of full strength Betadine® and a 2 ml spot of tincture of iodine and allowed to stand for 24 hours. After 24 hours the Betadine® stain was not present, the tincture of iodine area showed a 99% reduction of color, a slight yellow cast remained.

EXAMPLE 10

Example 9 was repeated in all respects except the concentration of OSA in solution was reduced to 10%. After 24 hours the Betadine® stain was not present, the tincture of iodine area showed a 50% reduction of color, a light brown color remained.

EXAMPLE 11

To a woven test strip fabric No. 5R from Testfabrics Inc., Middlesex N.J., full strength Betadine® solution was padded at about 60% wet pick up on the weight of fabric, allowed to dry and stain the fiber for 48 hours. The resulting light brown Betadine® stained fabric was then sprayed at room conditions with 30% active OSA solution and allowed to dry for 24 hours. All of the Betadine® stain was removed. NOTE: The test fabric contains strips of the following: acetate, SEF, Arnel, bleached cotton, Creslan 61, Dacron 54, Dacron 64, Nylon 6.6, Orlon 75, spun silk, polypropylene, viscose and wool.

EXAMPLE 12

Example 11 was repeated in all respects except the concentration of OSA was 1% active. All of the Betadine® stain was removed.

EXAMPLE 13

Two hundred and six-tenths gm of a urea-formaldehyde polymer, such as described in Malone et. al., U.S. Pat. No. 4,434,067, and 90.4 gm of OSA were blended together to produce a particulate containing 9.3 % active carboxyalkene. The particulate cleaner was applied to a nylon 6,6 cut pile bonded carpet tile (28 oz 1 yd$^2$ face weight), face fiber stock dyed light pewter grey, which had been stained with full strength Betadine® solution. The particulate cleaner was brushed into the face fiber, allowed to remain on the fiber for 30 minutes and then removed by vacuuming. Substantially all of the stain was removed. Treatment with the particulate cleaner was repeated and the stain was completely removed.

EXAMPLE 14

Two hundred three and three-tenths gm of a urea-formaldehyde polymer, such as described in Malone et. al., U.S. Pat. No. 4,434,067, 22.4 gm OSA, and 15.2 gm water were blended together to produce a particulate containing 2.8 % active carboxyalkene. The particulate cleaner was applied to a nylon 6,6 cut pile bonded carpet tile (28 oz 1 yd$^2$ face weight), face fiber stock dyed light pewter grey, which had been stained with full strength Betadine® solution. The particulate cleaner was brushed into the face fiber, allowed to remain on the fiber for 30 minutes and then removed by vacuuming. Substantially all of the stain was removed. Treatment with the particulate cleaner was repeated and the stain was completely removed.

There are, of course, many modifications and alternative embodiments of the invention, which are intended to be included within the scope of the following claims.

What we claim is:

1. A method of treating a substrate to decolorize an iodine stain, comprising the steps of staining a substrate with iodine, and applying a carboxyalkene to the substrate either before or after said staining so as to decolorize the iodine stain, the carboxyalkene having a site of unsaturation at the 4, 5-, 5, 6- or 6, 7-position relative to the carboxy group.

2. The method of claim 1 wherein the carboxyalkene is applied as an aqueous solution.

3. The method of claim 2 wherein the site of unsaturation is at the 4,5- or 5,6- position.

4. The method of claim 3 wherein the solution is applied to a textile substrate.

5. The method of claim 4 wherein the solution is applied to an existing iodine stain on the substrate.

6. The method of claim 3 wherein the solution is applied to a carpet and dried, prior to the carpet being stained with iodine.

7. The method of claim 1 wherein the solution is applied to a powdered cleaning agent and the agent is applied to an existing iodine stain on a textile substrate.

8. A method of treating a substrate to decolorize an iodine stain, comprising the steps of staining a substrate with iodine, and applying to the substrate, either before or after said staining so as to decolorize the iodine stain, an aqueous solution of a carboxyalkene, having a site of unsaturation at the 4,5- position, and a cationic counter ion to the carboxyalkene.

9. The method of claim 8 wherein the solution is applied to a textile substrate.

10. The method of claim 9 wherein the carboxyalkene is an alkenyl succinic acid.

11. The method of claim 8 wherein the carboxyalkene is selected from the group consisting of octenyl succinic acid, decenyl succinic acid, dodecenyl succinic acid and octadecenyl succinic acid.

12. The method of claim 9 wherein the solution is applied to an existing iodine stain on the substrate.

13. The method of claim 8 wherein the solution is applied to a carpet and dried, prior to the carpet being stained with iodine.

14. The method of claim 8 wherein the solution is applied to a powdered cleaning agent and the agent is applied to an existing iodine stain on a textile substrate.

* * * * *